US005330277A

United States Patent [19]

Kasai et al.

[11] Patent Number: 5,330,277

[45] Date of Patent: Jul. 19, 1994

[54] DRIVE SYSTEM FOR WIRE DOT HEAD

[75] Inventors: Tadashi Kasai; Takao Uchida; Jiro Tanuma; Naoji Akutsu; Chihiro Komori, all of Tokyo, Japan

[73] Assignee: Oki Electric Industry Co., Ltd., Tokyo, Japan

[21] Appl. No.: 964,260

[22] Filed: Oct. 21, 1992

[30] Foreign Application Priority Data

Oct. 25, 1991 [JP] Japan ..... 3-279619

[51] Int. Cl.[5] ..... B41J 2/30

[52] U.S. Cl. ..... 400/157.3; 400/124

[58] Field of Search ..... 400/124, 157.2, 157.3, 400/166

[56] References Cited

U.S. PATENT DOCUMENTS

| | | | |
|---|---|---|---|
| 3,872,788 | 3/1975 | Palombo | 400/157.2 |
| 3,928,796 | 12/1975 | Kaiser | 400/157.2 |
| 4,192,230 | 3/1980 | Blom et al. | 400/157.2 |
| 4,263,546 | 4/1981 | Morris | 324/61 R |
| 4,347,786 | 9/1982 | Sweat, Jr. et al. | 400/144.2 |
| 4,348,119 | 9/1982 | Carson, Jr. et al. | 400/157.2 |
| 4,433,926 | 2/1984 | Isobe et al. | 400/124 |
| 4,440,079 | 4/1984 | Dayger et al. | 400/157.3 |
| 4,468,140 | 8/1984 | Harris | 400/121 |
| 4,523,867 | 6/1985 | Berrey et al. | 400/124 |
| 4,597,328 | 7/1986 | Carrington et al. | 400/166 |
| 4,637,742 | 1/1987 | Sakai | 400/121 |
| 4,661,882 | 4/1987 | Presley | 361/159 |
| 4,740,094 | 4/1988 | Ueda | 400/144.2 |
| 4,797,017 | 1/1989 | Okouchi | 400/59 |
| 4,830,724 | 7/1989 | Fattori | 400/157.2 |
| 4,844,635 | 7/1989 | Malkemes et al. | 400/124 |
| 4,850,724 | 7/1989 | Fattori | 400/157 |
| 4,940,343 | 7/1990 | Kikuchi et al. | 400/124 |

FOREIGN PATENT DOCUMENTS

| | | | |
|---|---|---|---|
| 0117145 | 8/1984 | European Pat. Off. | 400/124 |
| 0294288 | 12/1988 | European Pat. Off. | 400/157.2 |
| 0305871 | 3/1989 | European Pat. Off. | 400/157.2 |
| 0318448 | 5/1989 | European Pat. Off. | 400/157.2 |
| 0380352 | 8/1990 | European Pat. Off. | 400/157.2 |
| 0446045 | 9/1991 | European Pat. Off. | 400/157.2 |
| 1914045 | 7/1976 | Fed. Rep. of Germany | 400/157.2 |
| 3112742 | 10/1982 | Fed. Rep. of Germany | 400/157.2 |
| 3427257 | 2/1985 | Fed. Rep. of Germany | 400/157.2 |
| 37358 | 3/1980 | Japan | 400/157.2 |
| 56-51375 | 8/1981 | Japan | 400/157.2 |
| 59-2864 | 1/1984 | Japan | 400/157.2 |
| 60-63173 | 4/1985 | Japan | 400/157.2 |
| 64-53860 | 3/1989 | Japan | 400/157.2 |
| 64-54375 | 3/1989 | Japan | 400/157.2 |
| 1-64449 | 4/1989 | Japan | 400/157.2 |
| 1-165456 | 6/1989 | Japan | 400/157.2 |
| 1-244869 | 9/1989 | Japan | 400/157.2 |
| 1280567 | 11/1989 | Japan | 400/157.2 |
| 1303124 | 3/1970 | United Kingdom | 400/157.2 |
| 2008285 | 5/1979 | United Kingdom | 400/157.2 |
| 2143970 | 7/1983 | United Kingdom | 400/157.2 |

OTHER PUBLICATIONS

Abstract, Patent Abstracts of Japan, vol. 14, No. 52 (M-928) (3995) Jan. 30, 1990.

J. Baumberger, "Hammer Flight Time Transducer and Measurement", IBM Technical Disclosure Bulletin, vol. 23, No. 9, Feb. 1981, pp. 4110–4111.

"Capacitive Head Gap Measurement For Printers", IBM Technical Disclosure Bulletin, vol. 29, No. 3, Aug. 1986, pp. 1412–1413.

*Primary Examiner*—David A. Wiecking
*Assistant Examiner*—Steven S. Kelley
*Attorney, Agent, or Firm*—Steven M. Rabin

[57] ABSTRACT

A drive system for a wire dot head is provided with sensors for detecting displacements of corresponding print wires. Each sensor outputs a movement initiation timing signal and an impact timing signal for the corresponding print wire. An electric current to be fed to an associated coil is normally controlled by these timing signals. It is detected whether these timing signals are obtained in a predetermined time period. If not, electric power is continuously fed to the coil or is forcedly cut off so that the timing signals are obtained within the predetermine time period.

5 Claims, 18 Drawing Sheets

I
G
E
F
L
K
COIL CURRENT

DRIVE SYSTEM FOR WIRE DOT HEAD

BACKGROUND OF THE INVENTION 1) Field of the Invention

This invention relates to a drive system for a wire dot head in an impact printer. 2) Description of the Related Art Wire dot printers have attracted a high demand to date because they do not impose any limitation on the type of printing medium and permit printing even on copying paper sheets or the like. Each wire dot printer is provided with a wire dot head which is constructed to drive each print wire by magnetic attractive force of an associated permanent magnet.

Such wire dot printers can each be classified into one of three groups depending on the type of its wire dot head, namely, into the plunger type, the spring-charged type or the clapper type.

In a spring-charged printer out of these printers, each armature with a print wire secured thereon is supported for rocking motion on a biasing leaf spring so that the armature is attracted on a core by a permanent magnet against resilient force of the biasing leaf spring. Upon printing, a coil wound around the core is energized to produce a magnetic flux in a direction opposite to the magnetic flux of the permanent magnet, whereby the armature is released from the core.

Incidentally, the drive time of a wire dot head has heretofore been determined in a whole-sale manner by a time circuit to set the drive time at an optimal value predicted based on empirical data of voltage variations of a power supply.

Due to variations in the characteristics of the wire dot head, variations in the distance between a free end of each print wire and a printing medium, magnetic interference between coils, variations in the characteristics of the coils, etc., the drive time set by the timer circuit may, however, deviate from a drive time actually required.

A shorter drive time leads to the problem that the impacting speed of the free end of each print wire against the printing medium is small and the energy upon printing is hence small to result in poor printing quality or the free end of each print wire does not reach the printing medium to make it impossible to perform printing. A longer drive time, on the other hand, leads to a delay in the application of attractive force subsequent to the projection of each print wire, so that the print wire is delayed in returning to its home position. The print wire cannot therefore project in time for the next print so that printing must be performed at a lower printing speed.

Wire dot head drive systems have therefore been provided, which can maintain the printing quality without the need for lowering the printing speed even when the required drive time varies from one printing operation to another or from one print wire to another (U.S. Pat. No. 4,940,343 and U.S. Pat. No. 5,030,020).

In each of such wire dot head drive systems, each print wire or its associated armature is provided with a sensor for detecting each displacement of the print wire or armature. A signal corresponding to the displacement of the print wire is obtained from the sensor to extract the initiation timing of a movement of the print wire and the timing of an impact of the printing wire against the printing medium. At these timings, an electric current to be fed to a corresponding coil is controlled.

In each of the conventional wire dot head drive system described above, however, the sensor provided for the detection of each displacement of each print wire or armature tends to be affected by noise because it relies upon the measurement of a resulting minute variation in capacitance. A large variation in the voltage of a power supply, which takes place by an induction noise from an adjacent circuit pattern on a printed circuit board or upon driving another print wire, may not be eliminated by a low-pass filter incorporated in a sensor circuit so that a timing pulse extractor may extract such a large voltage variation as a timing signal. In this case, signals may be switched over at a timing earlier than that expected initially. Further, a rebound of a print wire operated immediately before a sensor signal may change over the sensor signal at a timing much earlier than that expected initially.

In such a case, the time of impression of a drive voltage to a coil becomes shorter so that a printing blur or a missing dot tends to occur. Enhancement of a power supply pattern or the provision of a shield to avoid influence of noise, however, results in an increase in the number of parts, thereby leading to a larger and more costly wire dot head.

If the performance of a wire dot head is deteriorated by difficulties in feeding an electric current to each coil due to poor contact of connectors arranged in a current flow path or an unduly large drop in the voltage of a power supply or by an excessive reduction in the resilient force for each print wire, sensor signals are switched over at a timing much slower than that expected initially. In addition, no sensor signal may be outputted in some instances for deficient sensors, improper setting of the voltage, an excessive head gap or difficult movements of print wires. Even in such a case, the drive voltage is still impressed continuously. This leads not only to an increase in the power consumption by the coils and drive circuits but also to a malfunction of the wire dot head due to the generation of heat, burning, breakage of print wires, or the like.

Further, an unduly wide head gap results in an excessive delay in the timing at which print wires impact a printing medium. In this case, the return of each print wire subsequent to an impact is delayed so that the print wire may not be able to assume its home position in time for the next printing or the print wire may catch an ink ribbon to cause printing smear or print wire breakage. When a print wire catches the ink ribbon or printing medium or is broken for other reasons, the timing at which print wires impact the printing medium is also delayed excessively.

SUMMARY OF THE INVENTION

An object of the present invention is therefore to overcome the above-described problems of the conventional wire dot head drive systems and to provide a wire dot head drive system which permits high-quality printing. Another object of the present invention is to provide a drive system for a wire dot head, which drive system requires fewer parts.

In a wire dot head drive system according to the present invention, the timing of initiation of a movement of each print wire and the timing of an impact by the print wire are obtained by detecting a displacement of the print wire. An electric current to be fed to an associated coil is normally controlled at these timings. If these timings cannot be obtained in a predetermined time period, however, the electric current to be fed to the coil is controlled forcedly.

In the present invention, control means makes use of three timing signals to control the electric current to be fed to the coil. The first timing signal is produced from a print timing signal, which indicates the timing of printing, to supply electric power to the coil from a power supply. The second timing signal is produced from a movement initiation timing signal to cut off the supply of the electric power from the power supply and to permit continuous flow of the electric current to the coil. The third timing signal, on the other hand, is produced from an impact timing signal to discharge electrical energy stored in the coil.

To forcedly control the electric current to be fed to the coil, the minimum time from the output of the first timing signal until the output of the second timing signal is regulated in the present invention. The maximum time from the output of the first timing signal until the output of the second timing signal is also regulated. Further, the maximum time from the output of the first timing signal until the output of the third timing signal is also regulated. Owing to these regulations, the coil can be properly energized even when the movement initiation timing signal and the impact timing signal are not obtained in the predetermined time period.

DESCRIPTION OF THE PREFERRED EMBODIMENTS

The first to third embodiments of the present invention will hereinafter be described in detail with reference to the accompanying drawings.

Figure 1:
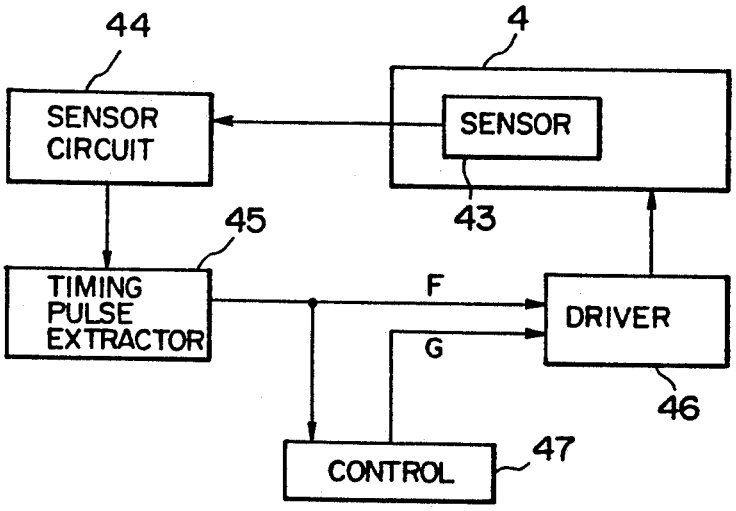
FIG. 1 is an internal block diagram of a drive circuit in a wire dot head drive system according to a first embodiment of the present invention.

Referring first to FIG. 1, the wire dot head drive system according to the first embodiment of the present invention comprises a wire dot head 4, a sensor 43, a sensor circuit 44, a timing pulse extractor 45, a driver 46 and a control 47.

The sensor 43 will next be described in detail with reference to FIGS. 3, 4 and 5.

Figure 3:
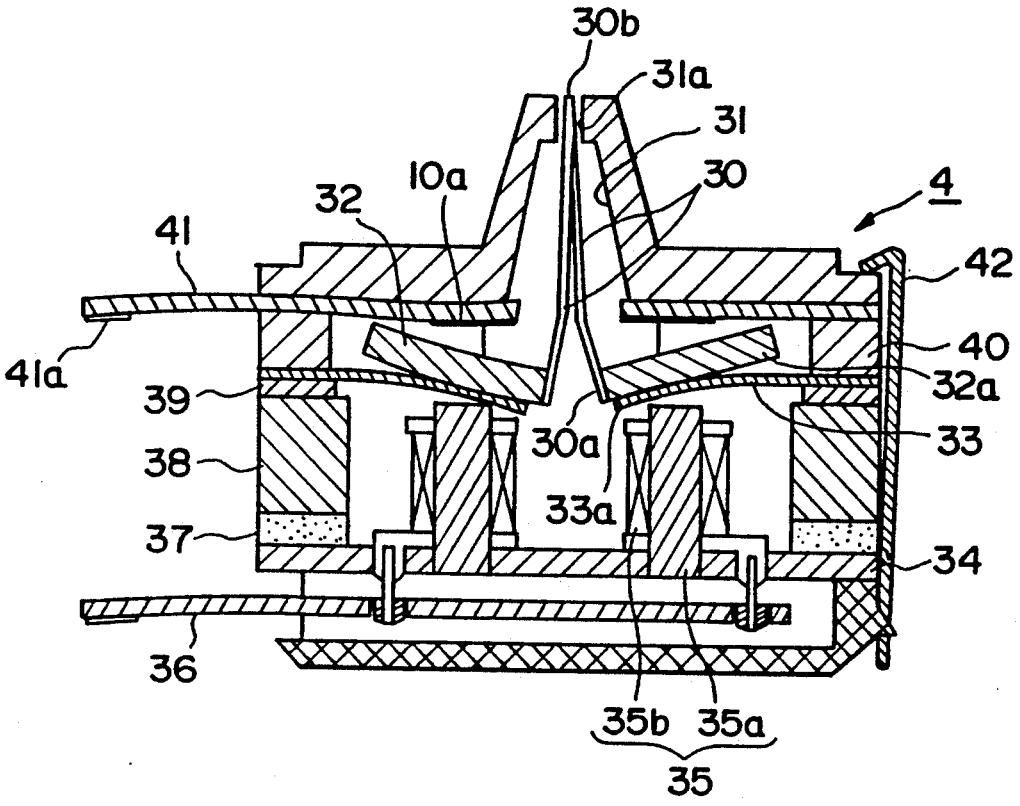
FIG. 3 is a vertical cross-section of a wire dot head.

In FIG. 3, the wire dot head 4 is constructed of plural (two in the drawing) print wires 30 arranged in the wire dot head 4, a front cover 31*a* having guide bores 31 for guiding the individual print wires 30, armatures 32 made of a magnetic material, and leaf springs 33 supporting the respective armatures 32. The wire dot head 4 also includes a base plate 34, electric magnets 35 formed by winding coils 35*b* around outer peripheries of cores 35*a*, respectively, a printed circuit board 36 having a printed circuit and connector terminals for supplying a drive current to the electric magnets 35, a permanent magnet 37, a base plate 38, a spacer 39, a yoke 40, a printed circuit board 41, and a clamp 42. The printed circuit board 36 is connected to a driver 46 through the connector terminals so that the drive current is supplied from the driver 36.

The clamp 42 holds under pressure the base plate 34, the permanent magnet 37, the base plate 38, the spacer 39, the leaf springs 33, the yoke 40, the printed circuit boards 41 and the front cover 31 in the state that they are integrally stacked one over another successively.

Each armature 32 is supported on the side of a free end 32*a* of the corresponding leaf spring 33. One of the print wires 30 is secured at a basal part 30*a* thereof on the free end 32*a* of the armature 32. It is designed that a free end portion 30*b* of the print wire 30 is guided by the guide bore 31*a* of the front cover 31 to impact a desired position of a printing medium.

Figure 4:
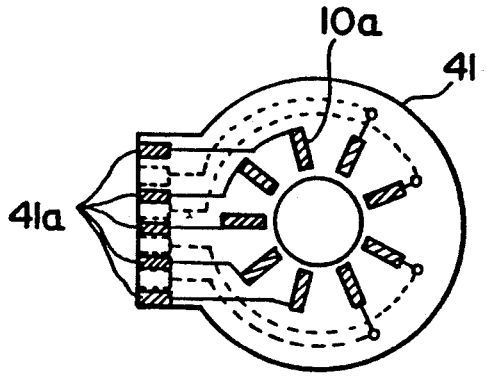
FIG. 4 is a plan view of a printed circuit board in the wire dot head.
Figure 5:
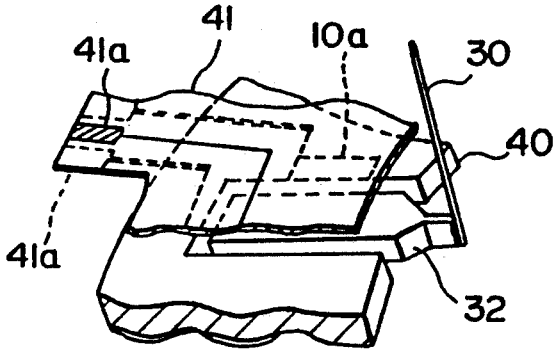
FIG. 5 is a fragmentary perspective view of the printed circuit board.

As is illustrated in FIGS. 4 and 5, sensor electrodes 10*a* formed of patterned copper films, respectively, are arranged on the printed circuit board 41 at positions opposing to the respective armatures 32. Each sensor electrode 10*a* is connected via a printed conductive path to each connector terminal 41*a* which is disposed at an edge portion of the printed circuit board 31. The printed circuit board 41 is coated with an insulating film to insulate it from the yoke 40. Accordingly, capacitance is produced between each sensor electrode 10*a* and its corresponding armature 32. The capacitance decreases as the interval therebetween becomes greater but increases as the interval therebetween becomes smaller.

The sensor 43 detects each displacement of the armature 32, namely, the print wire 30 on the basis of a corresponding variation in the capacitance. For this purpose, the printed circuit board 41 is connected to the sensor circuit 44 via the connector terminals 41*a*.

In the wire dot head 4 of the above-described construction, each armature 32 is attracted toward the base plate 34 (in a downward direction as viewed in FIG. 3) against the resilient force of the associated leaf spring 33 under the attractive force of the permanent magnet 37. When the coil 35*b* is energized in this state, the magnetic flux of the permanent magnet 37 is canceled out by the resulting magnetic flux of the electric magnet 35 so that the armature 32 is released from the attractive force of the permanent magnet 37 and is caused to move by the resilient force of the leaf spring 33 toward the front cover 31 (in an upward direction as viewed in FIG. 3). This movement of the leaf spring 33 also causes the armature 32 to move toward the front cover 31, whereby the associated print wire 30 projects out of the guide bore 31*a* and impacts the printing medium to conduct printing.

The yoke 40 makes up a part of a magnetic circuit which is formed by each electric magnet 35, and serves to eliminate any mutual interference between the sensor electrodes 10*a*.

Figure 6:
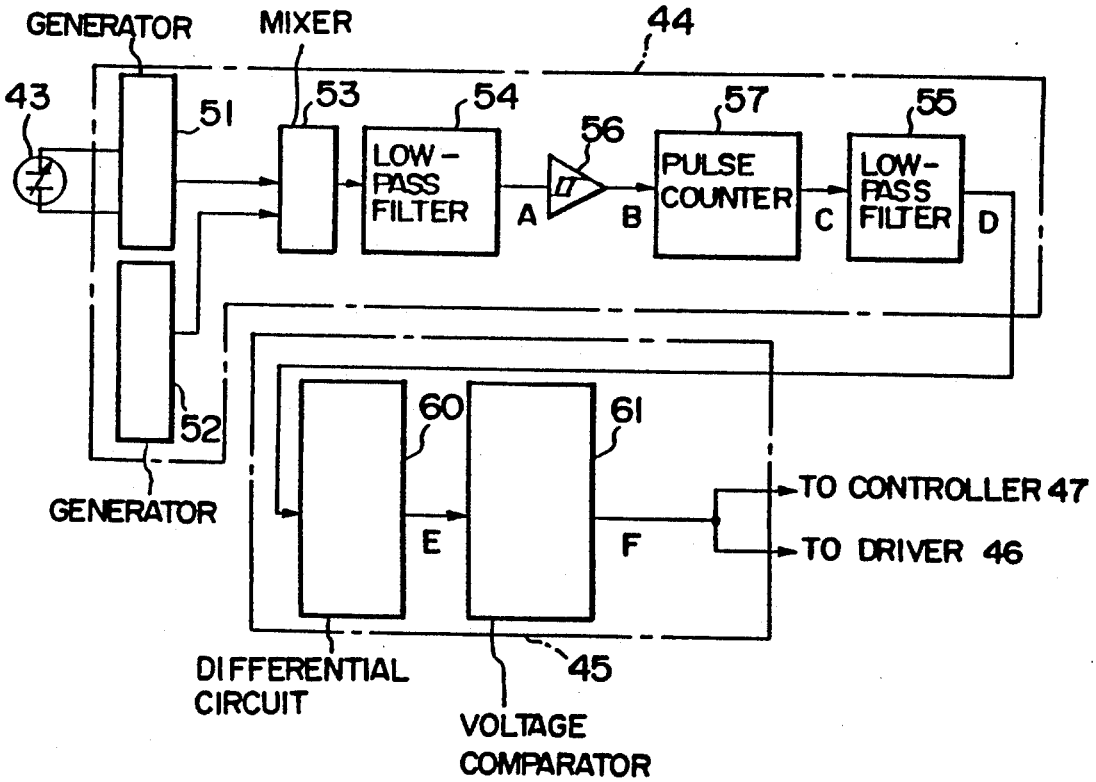
FIG. 6 is a detailed block diagram of a sensor circuit and a timing pulse extractor in the wire dot head drive system according to the first embodiment of the present invention.

Referring next to FIG. 6, the sensor circuit 44 for each sensor 43 is constructed of generators 51,52, a mixer 53, low-pass filters 54,55, a waveform shaper 56, and a pulse counter 57. Designated at numerals 60 and 61 are a differential circuit and a voltage comparator, which make up the timing pulse extractor 45 corresponding to the sensor circuit 44. Actually, each sensor 43 is provided with these sensor circuit 44 and timing pulse extractor 45.

The sensor 43 is connected to the generator 51, and the oscillation frequency of the generator 51 varies in accordance with the capacitance of the sensor 43. Further, an output of the generator 51 and an output of the generator 52 are both inputted to the mixer 53. The oscillation frequencies of the generators 51,52 are set at about 100 MHz and about 110 MHz, respectively. An output of the mixer 53 contains frequency components which represent the sum of the frequencies and the difference between the frequencies, respectively. The output of the mixer 53 is inputted to the low-pass filter 54, at which only the frequency component representing the difference of about 10 MHz is extracted and amplified.

The capacitance of each sensor 43 increases as the associated print wire 30 moves in the projecting direction but takes a minimum value when the associated print wire 30 has returned to its non-projected, home position. When the print wire 30 has displaced in the projecting direction, the oscillation frequency of the generator 51 is decreased so that the frequency of each output from the low-pass filter 54 becomes higher. Each output of the low-pass filter 54 is then delivered to the waveform shaper 56. After shaped into a square wave, the output of the low-pass filter 54 is fed to the pulse counter 57 constructed of a one-shot multivibrator, and is then inputted to the low-pass filter 55.

Figure 7:
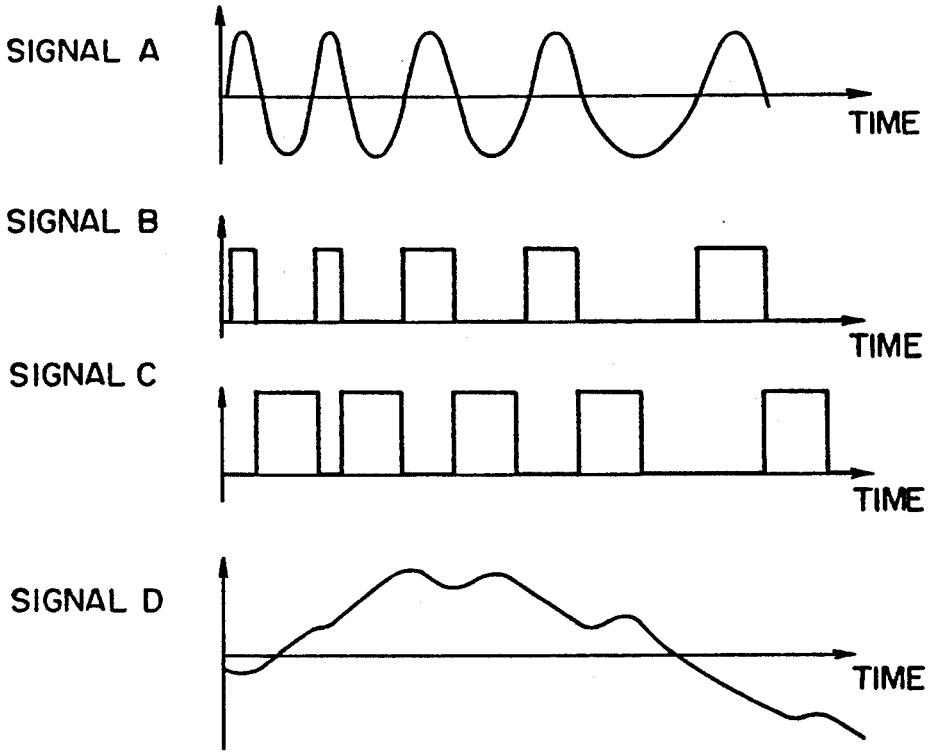
FIG. 7 is a time chart of the sensor circuit.

FIG. 7 shows the waveforms of the signal A outputted by the low-pass filter 54, the signal B outputted by the waveform shaper 56, the signal C outputted by the pulse counter 57 and the signal D outputted by the low-pass filter 55. Namely, variations in frequency are converted to a train of pulses of the same pulse width. The train of pulses is integrated so that the variations in frequency are obtained as variations in voltage. The voltage becomes higher in proportion to the degree of a displacement when the print wire 30 undergoes the displacement in the projecting direction. In this manner, each displacement of the print wire is converted to a voltage signal at the sensor circuit 44 and is then fed to the timing pulse extractor 45.

Figure 8:
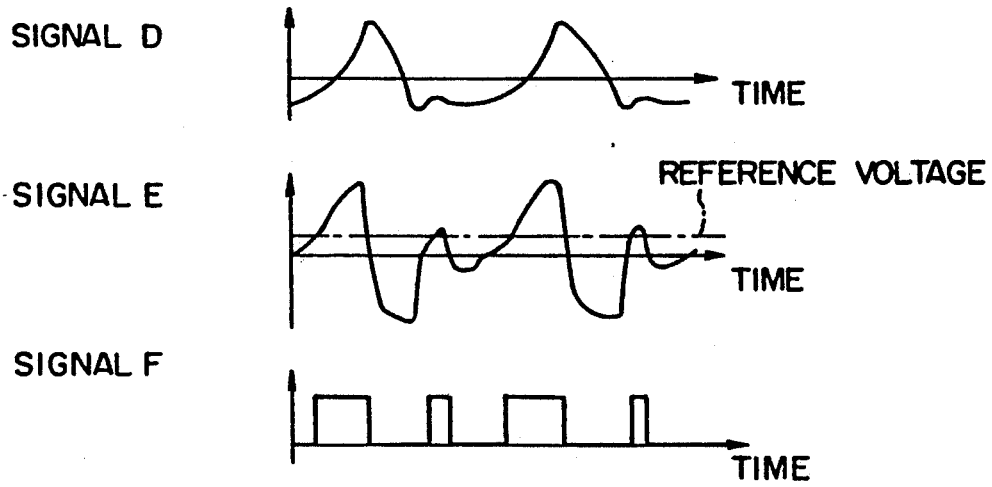
FIG. 8 is a time chart of the timing pulse extractor.

At the timing pulse extractor 45, the signal D outputted from the low-pass filter 55 is inputted to the differential circuit 60 and a signal E outputted from the differential circuit 60 is inputted to the voltage comparator 61. As is illustrated in FIG. 8, the signal D corresponding to the displacement of the print wire 30, said signal D having a different parameter on the time axis from the same signal in FIG. 7, is differentiated to eliminate any linear variation so that the signal E substantially corresponding to the speed of the movement (motion) of the armature 32 is produced and outputted. The initiation of a movement of the print wire 30 corresponds to the position where the moving speed of the armature 32 abruptly changes to a positive value. On the other hand, an impact of the print wire 30 corresponds to the position where the moving speed of the armature 32 abruptly changes from a positive value to a negative value. By comparing the signal E with a voltage slightly higher than 0, it is possible to detect these timings. This is conducted at the voltage comparator 61. In a sensor signal F outputted by the voltage comparator 61, a leading end of each pulse corresponds to the movement initiation timing of the print wire 30 while a trailing end of the pulse corresponds to the impact timing of the print wire 30.

Incidentally, the sensor signal F also contains a speed variation which takes place when the armature hits the associated core 35*a* and rebounds upon its return. The timing pulse extractor 45 outputs the sensor signal F of the voltage comparator 61 directly to the driver 46 and also to the control 47.

Figure 2:
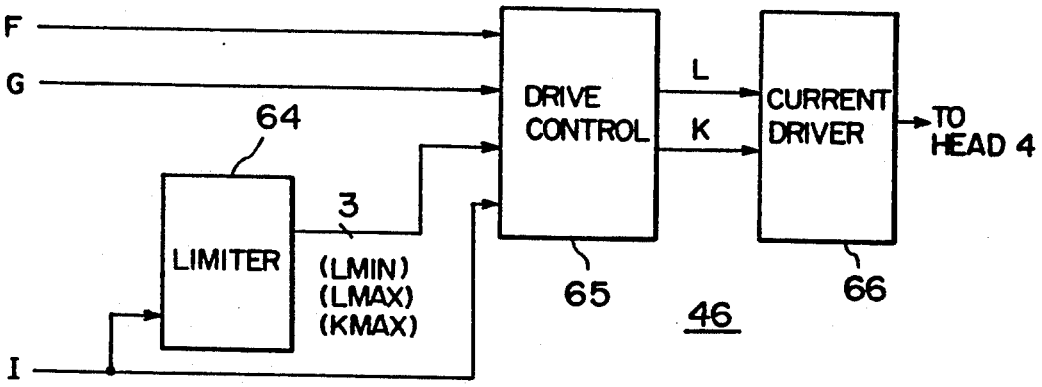
FIG. 2 is a block diagram of a driver in the wire dot head drive system according to the first embodiment of the present invention.

FIG. 2 is the internal block diagram of the driver 46, in which the driver 46 is constructed of a limiter 64, a drive control 65 and a current driver 66. The limiter 64 is inputted with a print trigger signal I from the control 47, whereby three types of signals LMIN, LMAX, KMAX are outputted to control the impression time and circulation time. The signals LMIN,LMAX-,KMAX and the print trigger signal I are inputted to the drive control 65. In addition, the drive control 65 is inputted with a print pattern signal G from the control 47 and also with a sensor signal F from the timing pulse extractor 45. The drive control 65 then outputs signals L,K to the current driver 66. Incidentally, the limiter 64 and the drive control 65 are each inputted with a common clock signal CLK and a common reset signal RESET although these common clock and reset signals are not shown in the drawing.

Figure 10:
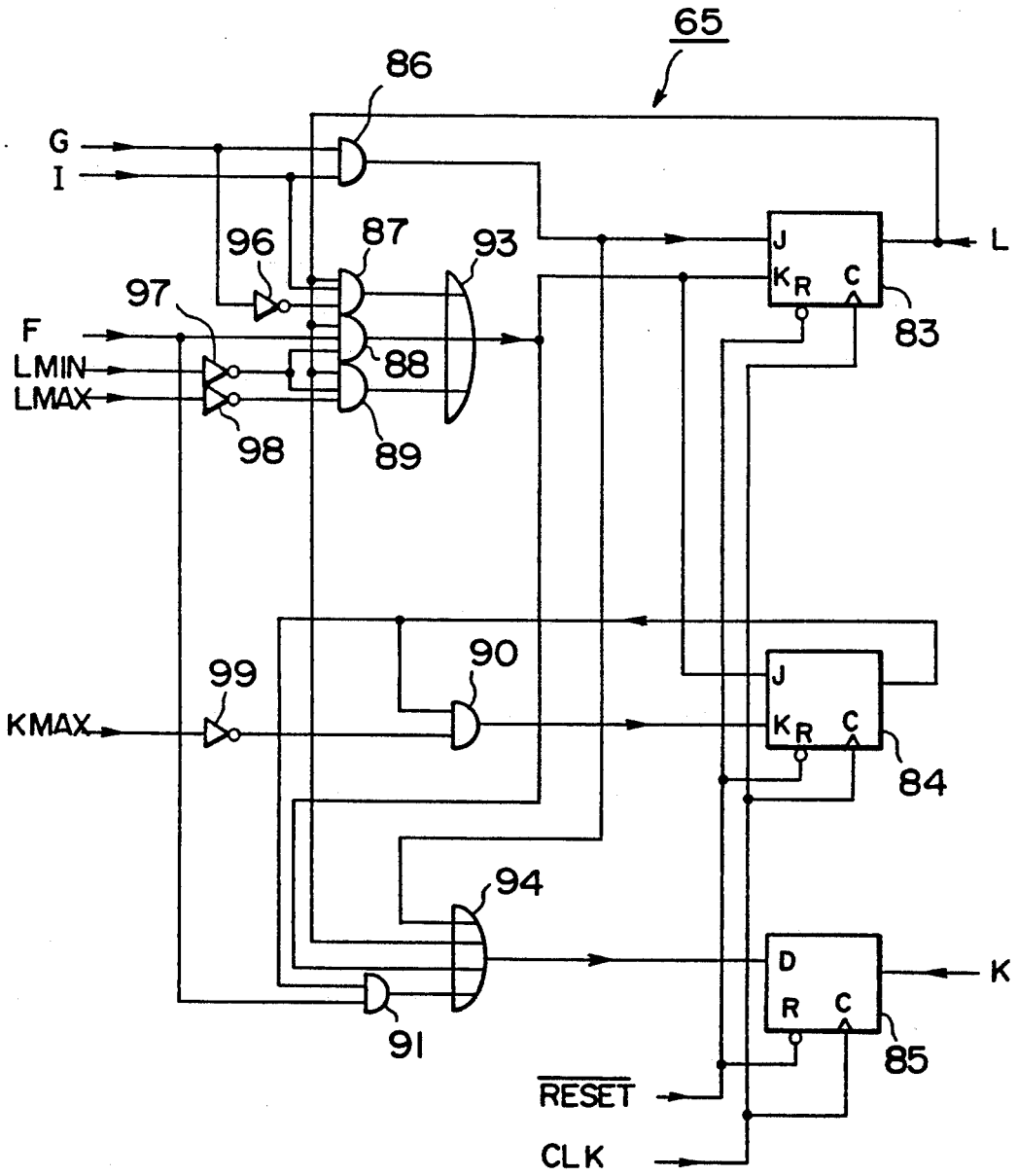
FIG. 10 is a detailed block diagram of a drive control in the wire dot head drive system according to the first embodiment of the present invention.
Figure 11:
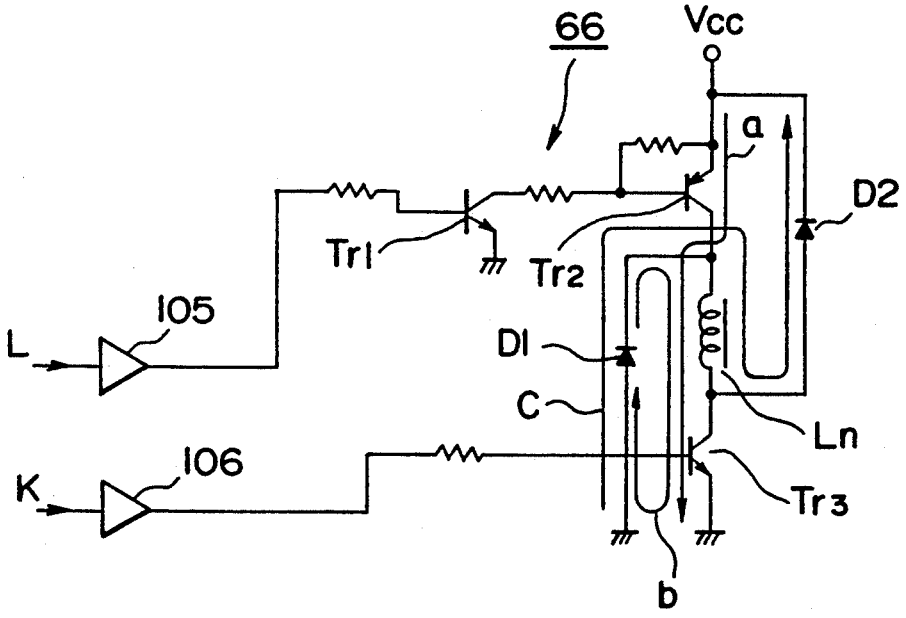
FIG. 11 is a detailed block diagram of each current driver in the wire dot head drive system according to the first embodiment of the present invention.
Figure 12B:
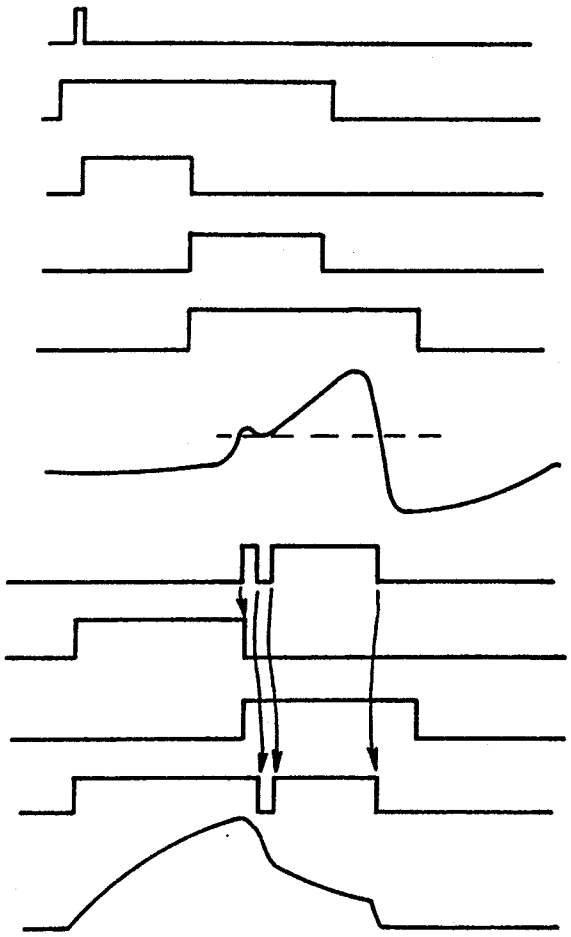
FIGS. 12A and 12B are first time charts of a wire head driver in the wire dot head drive system according to the first embodiment of the present invention.
Figure 12A:
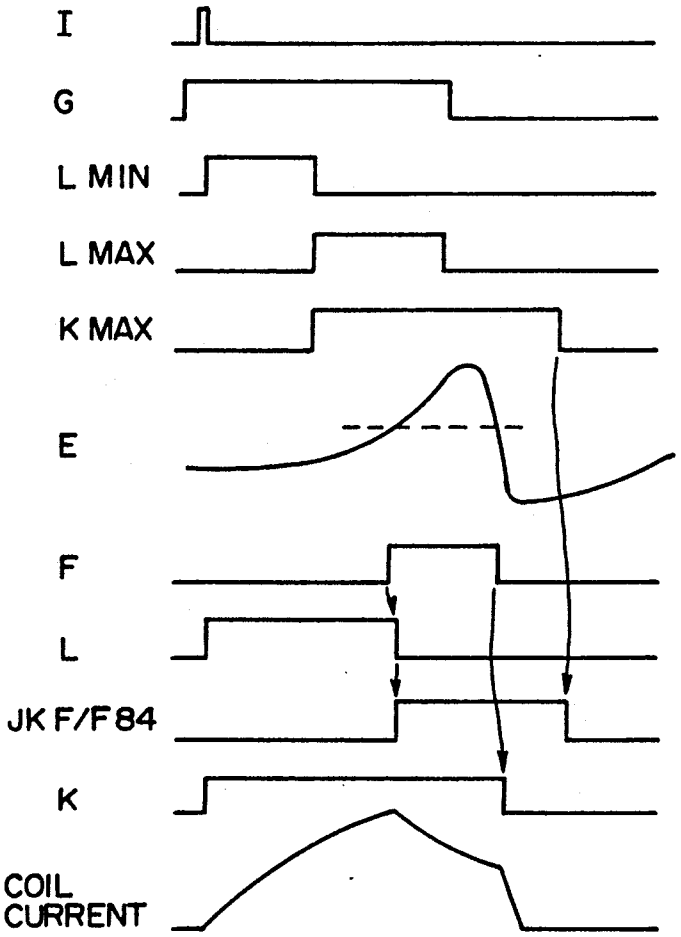

Reference is next made to FIGS. 9, 10, 11, 12A and 12B. FIG. 12A is a first time chart of the limiter 64 and drive control 65 in a normal operation, while FIG. 12B is a first time chart of the limiter 63 and drive control 65 upon waveform splitting of a signal from the sensor.

Figure 9:
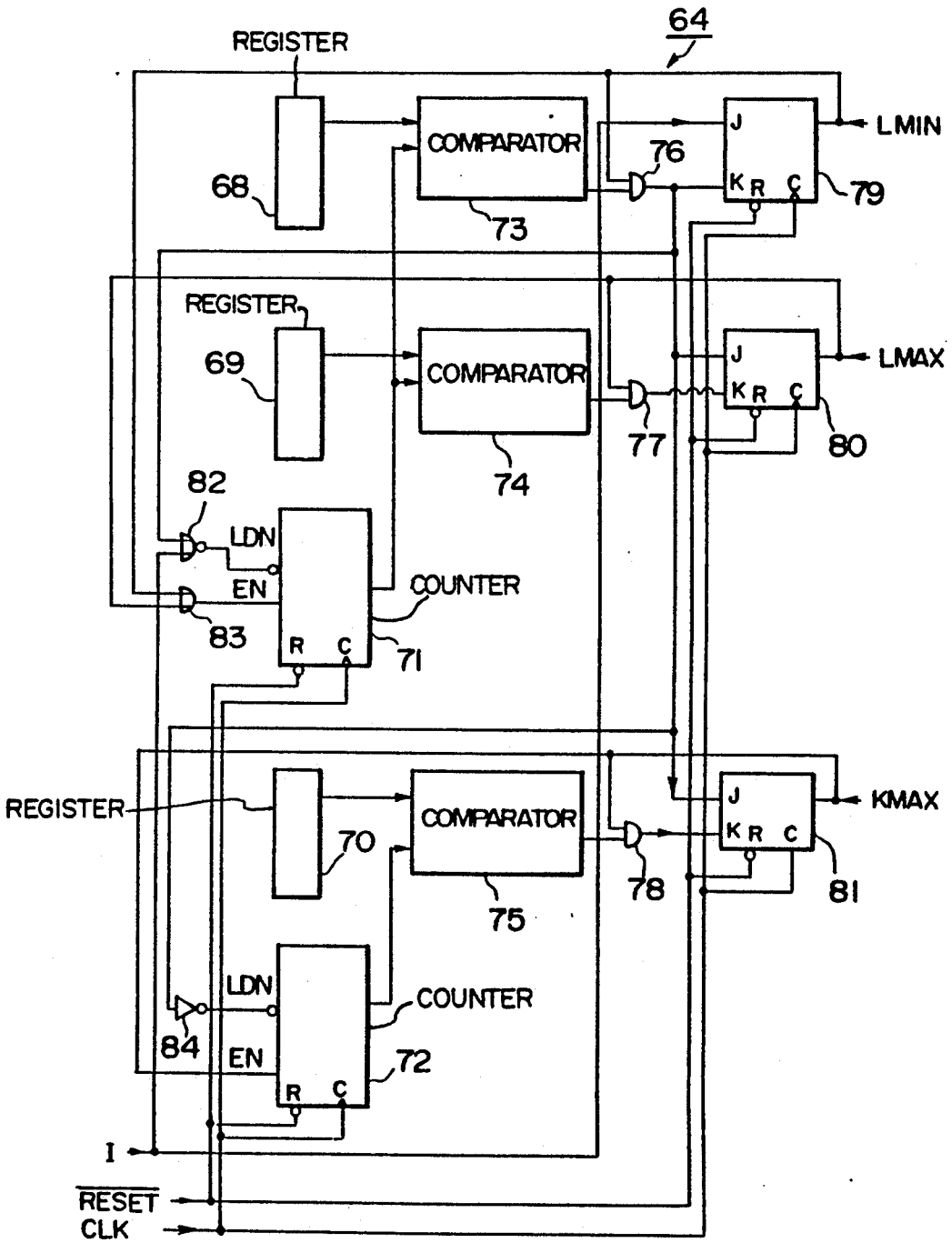
FIG. 9 is a detailed block diagram of a limiter in the wire dot head drive system according to the first embodiment of the present invention.

In FIG. 9, the limiter 64 is composed of registers 68–70, counters 71,72, comparators 73–75, AND gates 76–78, JK flip-flops 79–81, a NOR gate 82, an OR gate 83' and an inverter 84'. The registers 68–70 are connected to the control 47 (see FIG. 1) via unillustrated control lines, respectively. Predetermined values are set at the respective registers 68–70 prior to a printing operation.

The operation of the limiter 64 of the above-described construction will next be described with combined additional reference to FIG. 12.

The limiter 64 is provided to set a time in which the signals L,K for producing a coil current assume a high level (hereinafter referred to as "H"), in other words, become effective. The limiter 64 produces the above-described signals LMIN,LMAX and KMAX.

When the print trigger signal I is inputted from the control 47, an output signal of the NOR gate 82 assumes a low level (hereinafter referred to as "L"), in other words, becomes ineffective so that the counter 71 is loaded with "0", an initial value and the signal LMIN, an output signal from the JK flip-flop 79, assumes "H". Then, an enable signal EN to the counter 71 assumes "H" to initiate a counting operation. When the value of the counter 71 is gradually incremented and has become equal to the value of the register 68, an output signal of the comparator 73 assumes "H" so that an output signal of the AND gate 76 turns to "H". As a result, the output signal from the JK flip-flop 79 assumes "L". At this time, the output signal of the AND gate 76 is also inputted to the JK flip-flop 80 and the NOR gate 82. A signal LMAX, an output signal from the JK flip-flop 80, assumes "H" and the counter 71 is loaded with "0" to initiate a counting operation again.

Since the output signal from the AND gate 76 is inputted to the JK flip-flop 81 and also to the inverter 84' at the same time, the signal KMAX as an output signal from the JK flip-flop 81 assumes "H" and the counter 72 is loaded with "0" to initiate a counting operation.

When the value of the counter 71 becomes equal to the value of the register 69, the output signal of the comparator 74 assumes "H" so that the signal LMAX from the JK flip-flop 80 takes "L". The value of the register 70 is set greater than that of register 69. When the value of the counter 72 becomes equal to that of the register 70, the output signal from the comparator 75 becomes "H" and the signal KMAX from the JK flip-flop 81 assumes "L".

In FIG. 10, the drive control 65 is composed of JK flip-flops 83,84, a D flip-flop 85, AND gates 86–91, OR gates 93,94, and inverters 96–99. LMIN, LMAX and LMAX indicate signals from the limiter 64, G the print pattern signal from the control 47, F the sensor signal from the timing pulse extractor 45, and L,K the signals outputted to the current driver 66.

In FIG. 11, on the other hand, the current driver 66 is composed of buffer gates 105,106, transistors $Tr_1$-$Tr_3$, diodes D1,D2 and a coil Ln. When the signal K inputted to the buffer gate 106 becomes "H", the transistor $Tr_3$ is turned on. As a result, the electric power from the power supply Vcc is impressed to the coil Ln so that an impressed current flows as a coil current in the order of the power supply Vcc→the transistor $Tr_2$→the coil Ln→the transistor $Tr_3$→ground as indicated by arrow a.

When the signal L inputted to the buffer gate 105 assumes "L", the transistors $Tr_1$,$Tr_2$ are turned off so that the power supply Vcc is cut off. By electric power produced by the coil Ln, however, a current is circulated in the order of the coil Ln→the transistor $Tr_3$→ground→the diode D1→the coil Ln. When the signal K assumes "L" in this sate, the transistor $T_r$ is turned off so that the coil current is absorbed in the power supply Vcc via the diodes D1,D2 as indicated by arrow c. As a consequence, the coil current promptly drops to 0.

When the print pattern signal G from the control 47 becomes "H" and the print trigger signal I is inputted in the drive control 65 and the current driver 66 of the above-described construction, the print pattern signal G and the print trigger signal I are fed via the AND gate 86 and a signal L as an output signal from the JK flip-flop 83 assumes "H". The print pattern signal G and the print trigger signal I are also fed via the AND gate 86 and the OR gate 94 at the same time, whereby a signal K as an output signal from the D flip-flop 85 assumes "H". Since the JK flip-flop 83 retains "H" as long as no signal is inputted to a terminal K, a signal K from the D flip-flop 85 also assumes "H" during that time. Here, in the current driver 66, a coil current flows through the coil Ln as indicated by arrow a in FIG. 11.

When the print wire 30 begins to move after a little while, the level of the signal E outputted from the differential circuit 60 (see FIG. 6) gradually becomes higher. When the signal E has become higher than the reference voltage of the voltage comparator 61, the sensor signal F assumes "H". At this time, the signal LMIN is "L" and the output signal from the inverter 97 is "H". Via the AND gates 88,93, the signal L from the JK flip-flop 83 changes to "L" and, at the same time, the output signal from the JK flip-flop 84 becomes "H". An output signal from the AND gate 91 then becomes "H" so that the signal K from the D flip-flop 85 continues to retain "H". At this time, a coil current flows in the current driver 66 as indicated by arrow b in FIG. 11.

When the print wire 30 impacts the printing medium and the sensor signal F becomes "L", the output signal from the AND gate 91 becomes "L" so that the signal K from the D flip-flop 85 assumes "L". At this time, a coil current flows through the coil Ln in the current driver 66 as indicated by arrow c in FIG. 11. This coil current is then absorbed by the coil Ln so that it promptly drops to 0. This means completion of a single printing operation. After that, the output signal from the JK flip-flop 84 returns to "L" at the fall of the signal KMAX.

A description will next be made of the case that the sensor signal F undergoes waveform splitting under the influence of noise.

When the signal E becomes as shown in FIG. 12B by noise while the signal L from the JK flip-flop 83 and the signal K from the D flip-flop 85 are at "H" as illustrated in FIG. 10, waveform splitting occurs in the sensor signal F. At the rise of the noise, the signal L from the JK flip-flop 83 becomes "L" while the output signal from the JK flip-flop 84 becomes "H". At the fall of the noise, the signal K from the D flip-flop 85 becomes "L". When the sensor signal F assumes "H" after a little as a result of a sensor output at the level as designed initially, the signal K from the D flip-flop 85 assumes "H". The signal K remains at "H" while the sensor signal F assumes "H". When the sensor signal F becomes "L", the signal K changes to "L". At this time, the coil current becomes as depicted in the drawing so that the drive time is prolonged until the timing is switched over by the sensor 43.

Figures 13A, 13B:
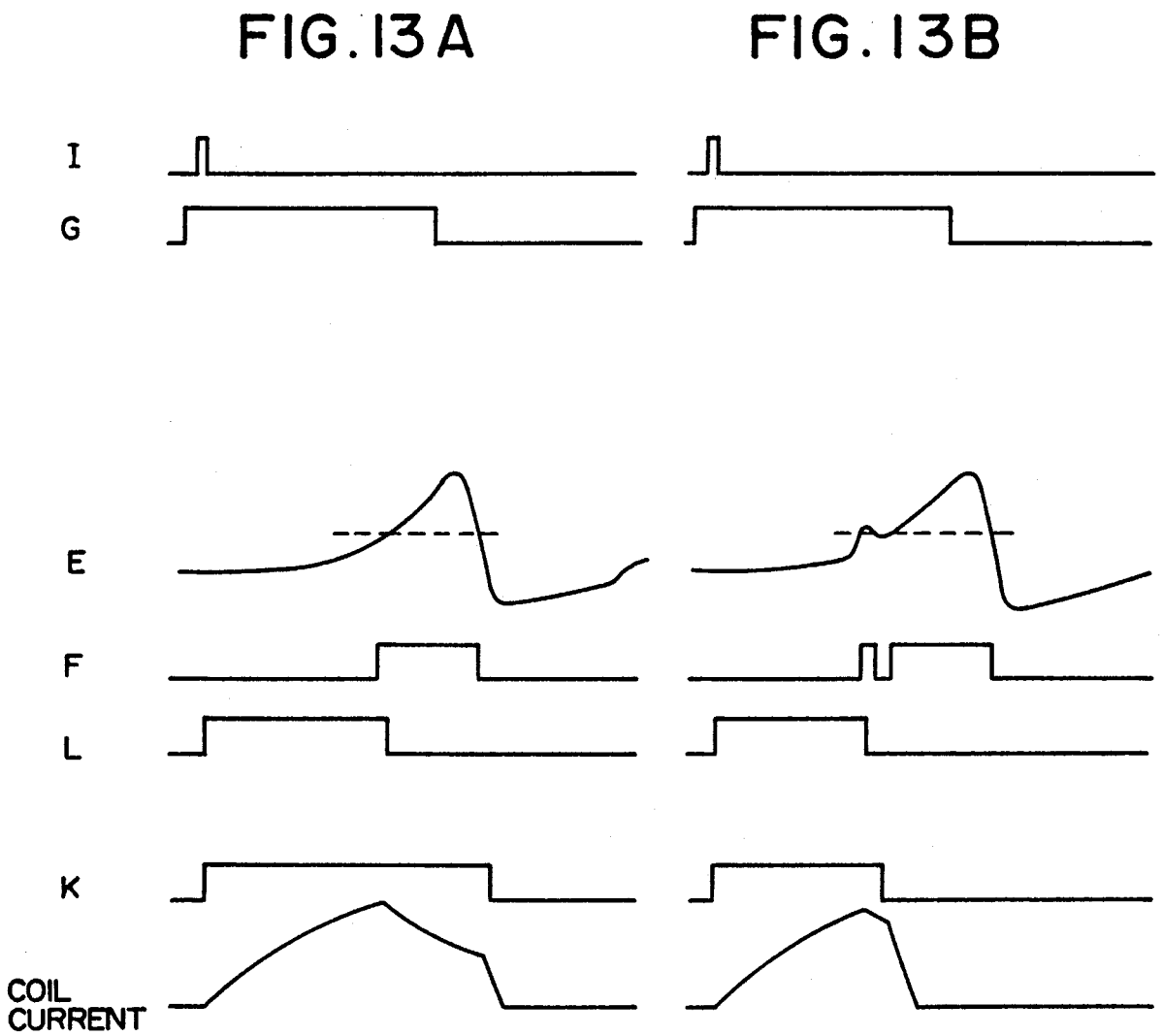
FIGS. 13A and 13B are time charts of a conventional wire head driver.

Referring now to FIGS. 13A and 13B, a description will be made of a time chart upon waveform splitting of a sensor signal in the conventional wire dot head drive system.

When noise occurs in the sensor signal F as shown in FIG. 13B, the signal L assumes "L" at the rise of the noise and the signal L then retains "L". At the fall of the noise, the signal K becomes "L" and then retains "L" as is.

As has been described above, it is understood that, upon waveform splitting of a signal from the sensor, the time during which the coil current flows becomes substantially shorter than the application time in a normal operation.

In contrast, the coil current is allowed to flow longer in the drive system of this invention for the wire dot head 4 because the signal K is designed to assume "H" again at the rise of a normal sensor signal F subsequent to the fall of noise as depicted in FIG. 12B.

In FIG. 11, the signal L is to make the impression signal flow to the coil Ln as indicated by arrow a while the signal K is to make an electric current flow as indicated by arrow b. To output the signals L,K in proper waveforms, respectively, the minimum and maximum values of the time during which the signal L is made effective are set. To set the maximum value of the time during which the signal K is rendered effective, the signals LMIN, LMAX, KMAX are produced. Further, the fall of the signal L is set to fall within the range from the fall of the signal LMIN to the fall of the signal LMAX and the fall of the signal K is set to fall within the range from the fall of the signal L to the fall of the signal KMAX. As long as they wall within these ranges, respectively, the drive time can be controlled to a value optimal to printing in accordance with the capacitance detected by the sensor 43. If the sensor 43 outputs an abnormal value so that the falls of the signals L,K fall outside their respective ranges described above, the drive time is set by any one of the following four methods in order to ensure the printing operation.

Figures 14A, 14B:
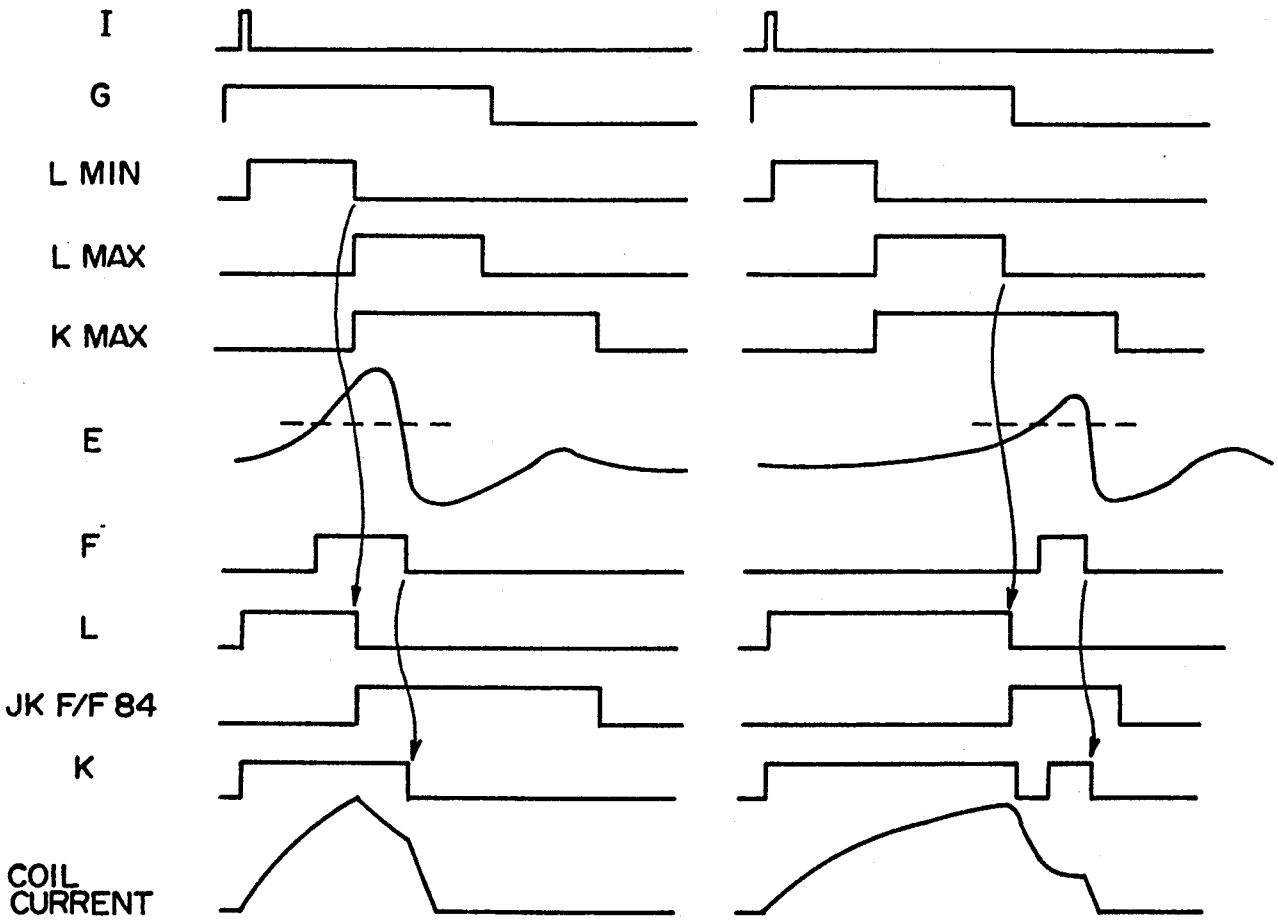
FIGS. 14A and 14B are second time charts of the wire head driver.
Figures 15A, 15B:
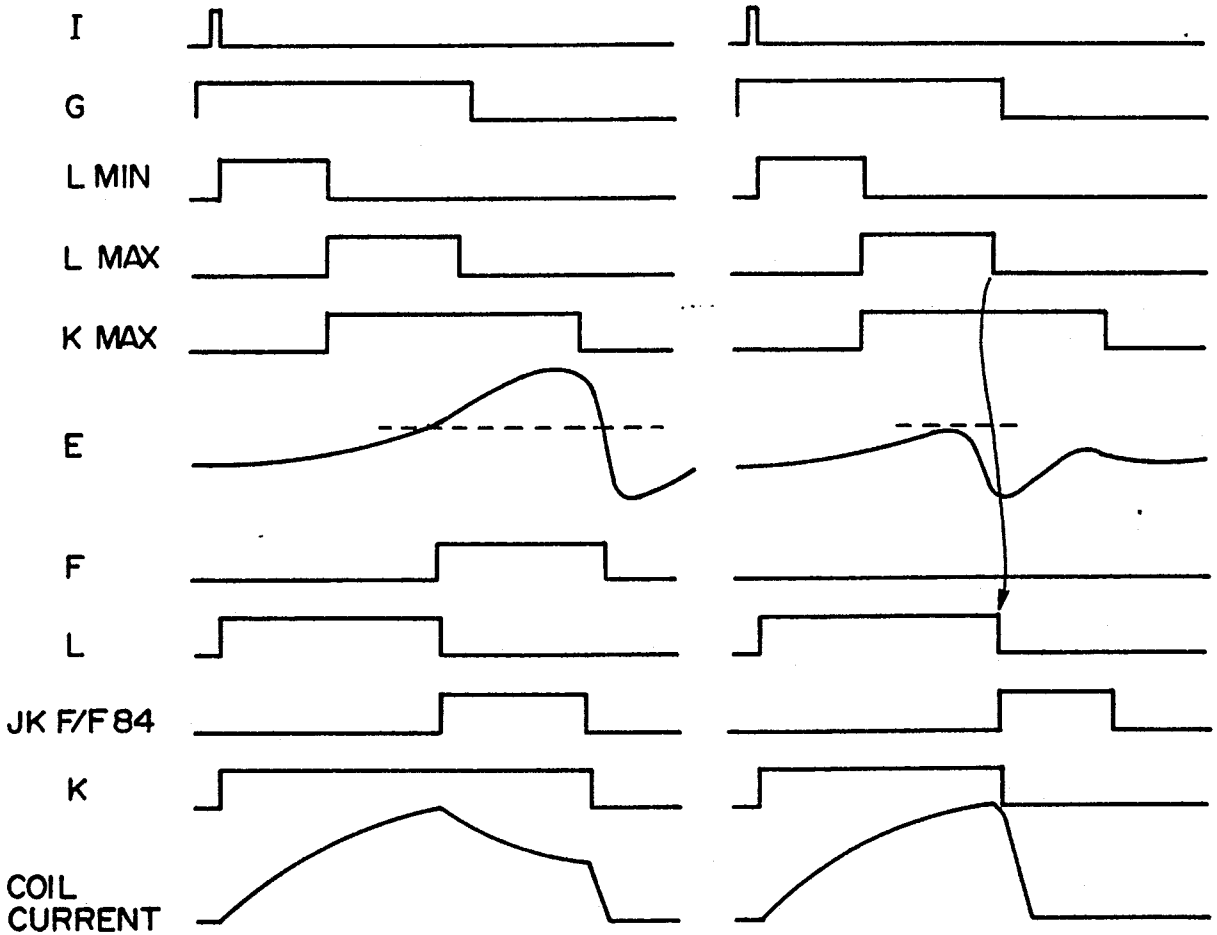
FIGS. 15A and 15B are third time charts of the wire head driver.

The time chart of FIG. 14A corresponds to a case in which the sensor signal F falls prior to the signal LMIN, the time chart of FIG. 14B to a case in which the sensor signal F falls after the signal LMAX, the time chart of FIG. 15A to a case in which the sensor signal F falls after the signal KMAX, and the time chart of FIG. 15B to a case in which the sensor signal F is not outputted.

Figure 16:
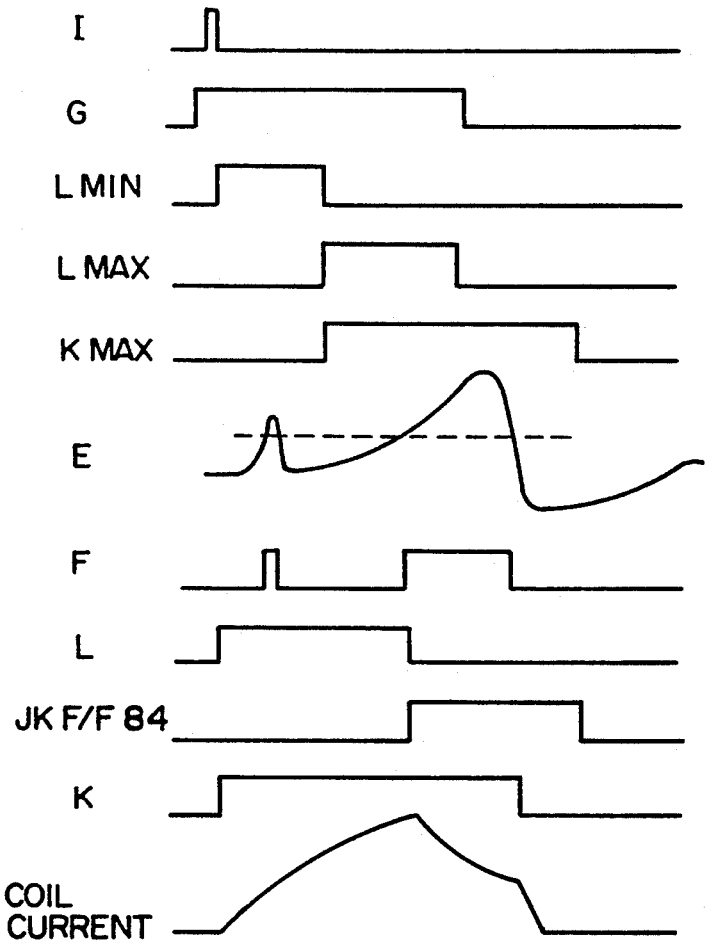
FIG. 16A is a fourth time chart of the wire head driver.

If the signal L assumes "L" at the rise of the sensor signal F, the effective time of the signal L becomes very short. The signal L is therefore retained at "H" until the fall of the signal LMIN in FIG. 14A. By doing so, the signal L is prevented from turning to "L" before the fall of the signal LMIN. Even when the signal from the sensor undergoes waveform splitting before the fall of the signal LMIN as illustrated in FIG. 16, the signal L is prevented from becoming "L" so that the printing operation is ensured. In other words, the maximum value of the drive time can be set.

In FIG. 14B, the rise of the sensor signal F takes place late. If the rise is waited for, the effective time of the signal L becomes longer. The signal L is hence cut off after the fall of the signal LMAX. In this case, the signal K is also cut off at the same time and, after that, the signal K is again changed to "H" at the rise of the sensor signal F and the signal K is again changed to "L" at the fall of the sensor signal F.

Since the signal L is not retained continuously at "H" after the fall of the signal LMAX, the maximum value of the time during which the signal L is made effective can be set. The electric current may be allowed to circulate until the fall of the sensor signal F without cutting off the signal K even after the fall of the signal LMAX. It is however an abnormal state so that cut-off of the electric current is more suitable for the protection of the current driver.

In FIG. 15A, the fall of the sensor signal F takes place late so that the effective time of the signal K becomes very long if the fall of the sensor signal F is waited for. The signal K is cut off at the fall of the signal KMAX, whereby the signal K is changed to "L".

In FIG. 15B, the signals L,K are continuously retained at "H" because the sensor signal F is not outputted. Accordingly, the signals L,K are cut off at the fall of the signal LMAX. Incidentally, the signal K may be cut off at the fall of the signal KMAX. For the protection of the current driver, it is however more suitable to cut off the signals L,K at the fall of the signal LMAX as described above.

The range in which suitable printing operations can be performed is set by the signals LMIN,LMAX-,KMAX as described above. To output the signals LMIN,LMAX, KMAX, the values of the registers 68–70 in the limiter 64 are set in advance.

The first embodiment has been described above with respect to the single print wire 30. The actual wire dot head 4 has 9 or 24 print wires. Each of the print wires 30 is provided with the sensor 43, the sensor circuit 44, the timing pulse extractor 45, the drive control 65 and the current driver 66. Although each of the print wires 30 may also be provided with the limiter 64, the limiter 64 can be shared by a plurality of drive controls 65. In such a case, the size of the circuit can be reduced.

Figure 17:
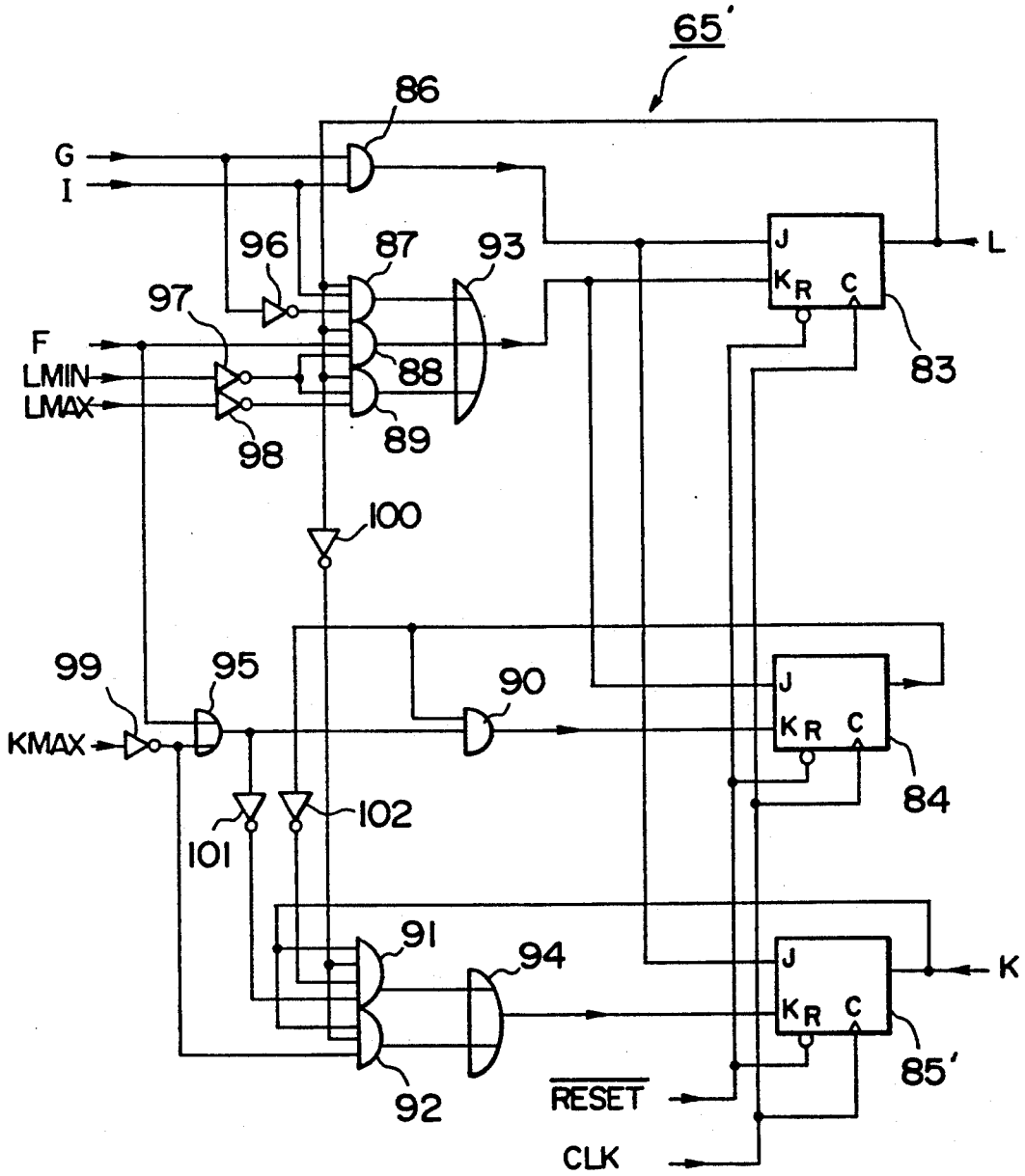
FIG. 17 is a detailed block diagram of a drive control in a wire dot head drive system according to a second embodiment of the present invention.
Figure 18A:
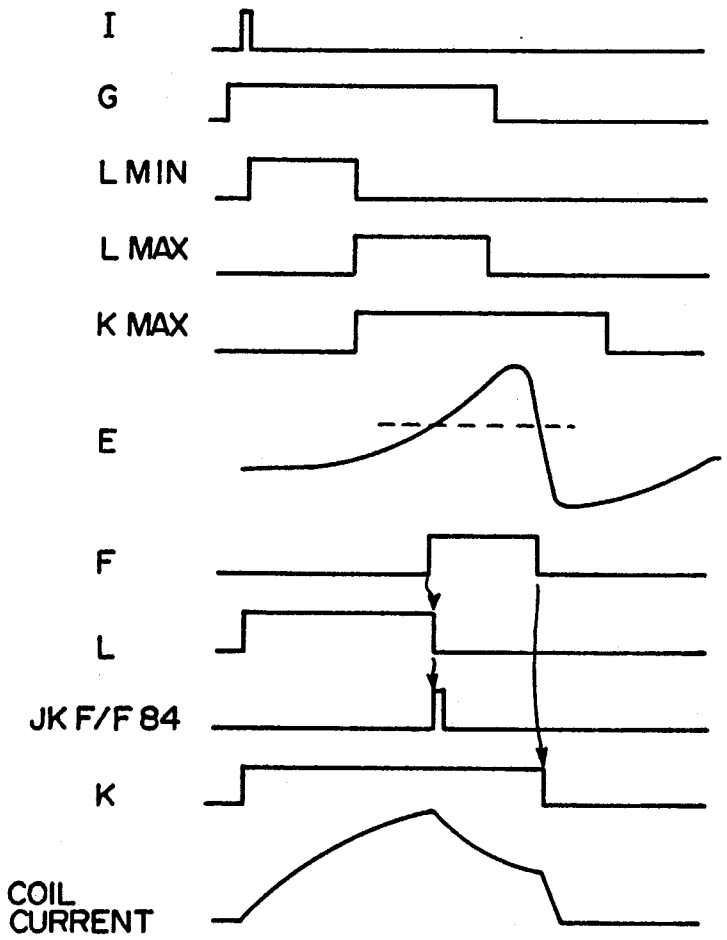
FIGS. 18A and 18B are first time charts of a wire head driver in the wire dot head drive system according to the second embodiment of the present invention.
Figure 18B:
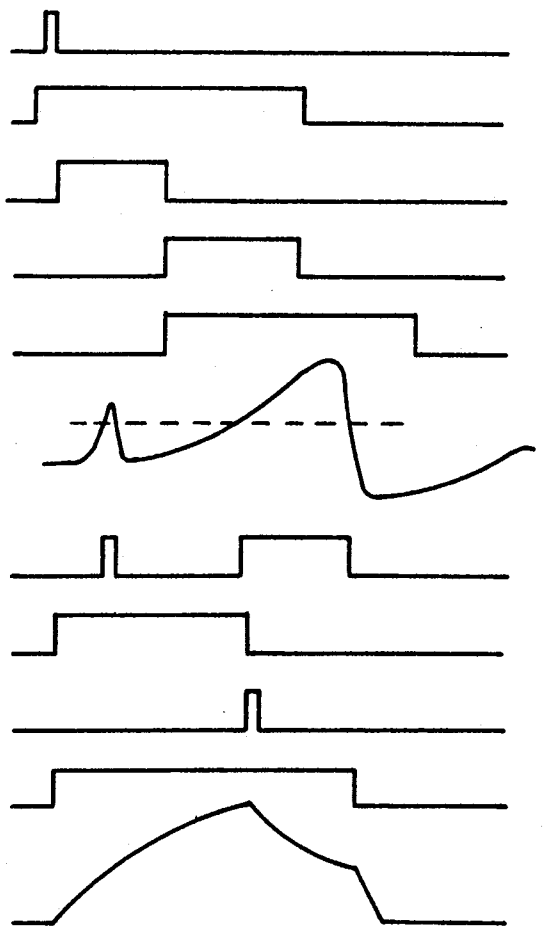

With reference to FIGS. 17, 18A and 18B, the wire dot head drive system according to the second embodiment of the present invention will be described next.

In FIG. 17, a drive control 65' includes JK flip-flops 83,84,85, AND gates 86–92, OR gates 93–95, and inverters 96–102. LMIN, LMAX and KMAX indicate the signals from the limiter 64 (see FIG. 2), G the print pattern signal from the control 47 ( see FIG. 1 ), I the print trigger signal from the control 47, F the sensor signal from the timing pulse extractor 45, and L and K the signals outputted to the current driver 66. The print pattern signal G assumes "H" when printing is performed.

When the print pattern signal G becomes "H" and the trigger signal I is inputted in the drive control 65' and the current driver 66 (see FIG. 11) of the above-described construction, the signals G,I are fed via the AND gate 86 so that the signal L as an output signal from the JK flip-flop 83 assumes "H". The signals G,I are also fed via the AND gate 86 and the OR gate 94, whereby the signal K as an output signal from the JK flip-flop 85' also assumes "H". Since the JK flip-flop 83 retains "H" as long as no signal is inputted to a terminal K thereof, the JK flip-flop 85' connected via the inverter 100 to the JK flip-flop 83 also retains "H" during that time. Here, an impression current flows to the coil Ln in the current driver 66 as shown by arrow a in FIG. 11.

When the print wire 30 begins to move after a little while, the level of the signal E outputted from the differential circuit 60 (see FIG. 6) gradually becomes higher. When the signal E has become higher than the reference voltage of the voltage comparator 61, the sensor signal F assumes "H". At this time, the signal LMIN is "L" and the output signal from the inverter 97 is "H". Via the AND gates 88,93, the signal L from the JK flip-flop 83 changes to "L" and, at the same time, the output signal from the JK flip-flop 84 becomes "H". An output signal from the AND gate 91 then becomes "H" so that the signal K from the D flip-flop 85 continues to retain "H". At this time, a coil current flows in the current driver 66 as indicated by arrow b in FIG. 11.

When the print wire 30 impacts the printing medium and the sensor signal F becomes "L", the output signal from the OR gate 95 becomes "L". The output signal from the OR gate 95 is fed via the inverter 101 and the AND gate 91, so that the output signal from the OR gate 94 assumes "H". Accordingly, the signal K from the JK flip-flop 85' assumes "L". At this time, a coil current flows through the coil Ln in the current driver 66 as indicated by arrow c in FIG. 11. This coil current is then absorbed by the coil Ln so that it promptly drops to 0. This means completion of a single printing operation. After that, the output signal from the JK flip-flop 84 returns to "L" at the fall of the signal KMAX.

A description will next be made of the case that the sensor signal F undergoes waveform splitting under the influence of noise.

When the signal E becomes as shown in FIG. 18B by noise while the signals L,K from the JK flip-flops 83,85' are at "H" as shown in FIG. 18B, waveform splitting occurs in the sensor signal F. Since the signal L is at "L" during this time, the output signal from the inverter 100 assumes "L". The output signals from the AND gates 91,92 therefore assume "L", so that the signal K from the JK flip-flop 85' retains "H".

Figures 19A, 19B:
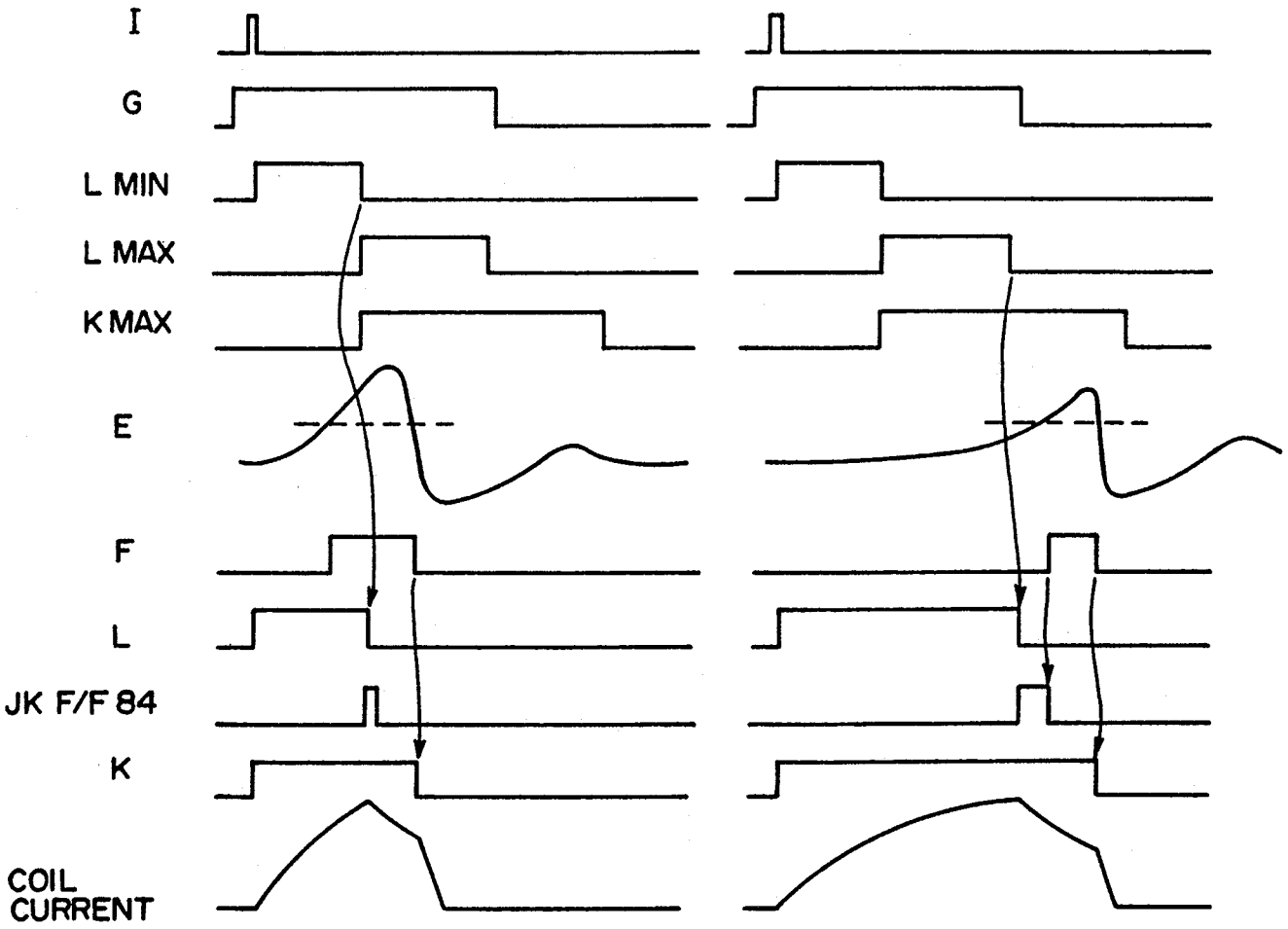
FIGS. 19A and 19B are second time charts of the wire head driver in the wire dot head drive system according to the second embodiment of the present invention.
Figures 20A, 20B:
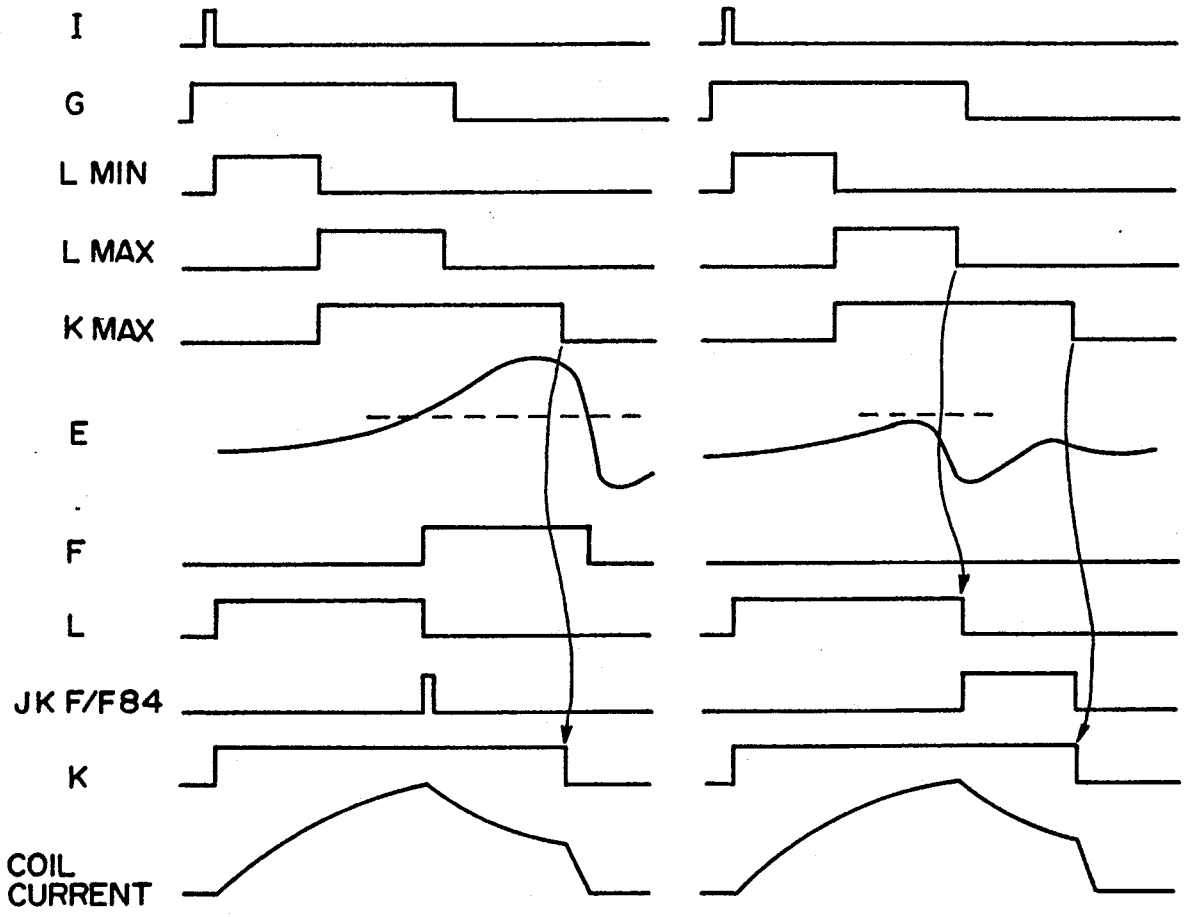
FIGS. 20A and 20B are third time charts of the wire head driver in the wire dot head drive system according to the second embodiment of the present invention.

The time chart of FIG. 19A corresponds to a case in which the sensor signal F rises prior to the fall of the signal LMIN, the time chart of FIG. 19B to a case in which the sensor signal F rises after the fall of the signal LMAX, the time chart of FIG. 20A to a case in which the sensor signal F falls after the signal KMAX, and the time chart of FIG. 20B to a case in which the sensor signal F is not outputted.

If the signal L assumes "L" at the rise of the sensor signal F, the effective time of the signal L becomes very short. The input signal to the JK flip-flop 83 is retained at "L" until the fall of the signal LMIN so that the signal L is retained at "H" as shown in FIG. 19A. By doing so, the signal L is prevented from turning to "L" before the fall of the signal LMIN. Even when the signal from the sensor undergoes waveform splitting before the fall of the signal LMIN as illustrated in FIG. 18B, the signal L is prevented from becoming "L" so that the printing operation is ensured. In other words, the minimum value of the impression time can be set.

In FIG. 19B, the rise of the sensor signal F takes place late. If the rise is waited for, the effective time of the signal L becomes longer. The signal L is hence cut off after the fall of the signal LMAX, whereby the signal L is changed to "L". In this case, the signal LMIN is at "L", the input signal to the JK flip-flop 83 is changed to "H" to have the signal L assume "L". At this time, the output signal from the JK flip-flop 84 becomes "H", and this state is retained until the sensor signal F rises. When the sensor signal F rises and then falls, the signal K from the JK flip-flop 85' becomes "L".

The signal L is therefore not retained continuously at "H" after the fall of the signal LMAX, so that the effective time of signal L can be set at the maximum value.

In FIG. 20A, the fall of the sensor signal F takes place late so that the effective time of the signal K becomes very long if the fall of the sensor signal F is waited for. The signal K is cut off at the fall of the signal KMAX, whereby the signal K is changed to "L". In other words, when the signal KMAX becomes "L" before the fall of the sensor signal F, the signal K from the JK flip-flop 85' assumes "L".

In FIG. 20B, the sensor signal F is not outputted so that the signals L,K are retained at "H". Accordingly, the signal L is cut off after the fall of the signal LMAX and the signal K is cut off after the fall of the signal KMAX. Namely, the signal L from the JK flip-flop 83 is changed to "L" at the fall of the signal LMAX. At this time, the output signal from the JK flip-flop 84 becomes "H" and retains at the same level until the sensor signal F becomes "H". During this period, the signal K from the JK flip-flop 85' remains at "H". The signal K from each of the JK flip-flops 84,85' then changes to "L" at the fall of the signal KMAX.

In view of variations in the required drive time, the wire dot head 4 has heretofore been driven by giving some tolerance to the drive time. Optimization of the drive time can shorten the drive time, thereby making it possible to reduce the heat produced by the wire dot head 4 and, hence, to save the power consumption.

In FIG. 9, the limiter 64 is composed of logic circuits such as the counters 71,72. As alternatives, the limiter 64 can be composed of analog circuits such as one-shot timers or can be constructed by a software by using an internal timer of the control 47. The signals LMIN, LMAX, KMAX can be independently produced by starting a timer responsive to the input of the print trigger signal I. The signal KMAX can be changed to "H" at the fall of the signal LMAX.

Next, a further setting method of the limiter 64 will be described with reference to FIGS. 21 and 22.

Figure 21:
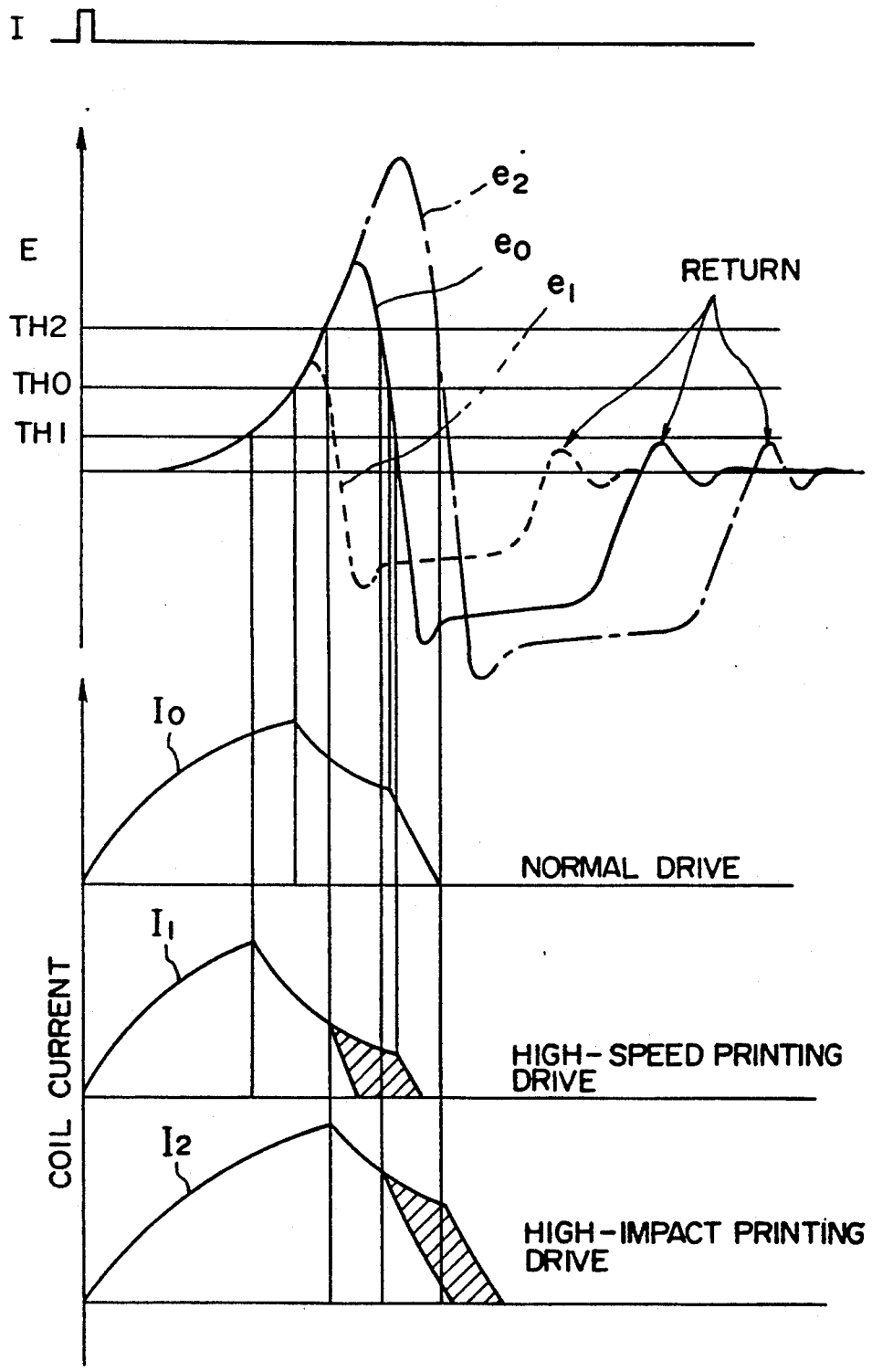
FIG. 21 diagrammatically illustrates the state of a drive by a wire dot head drive system according to a third embodiment of the present invention.
Figure 22:
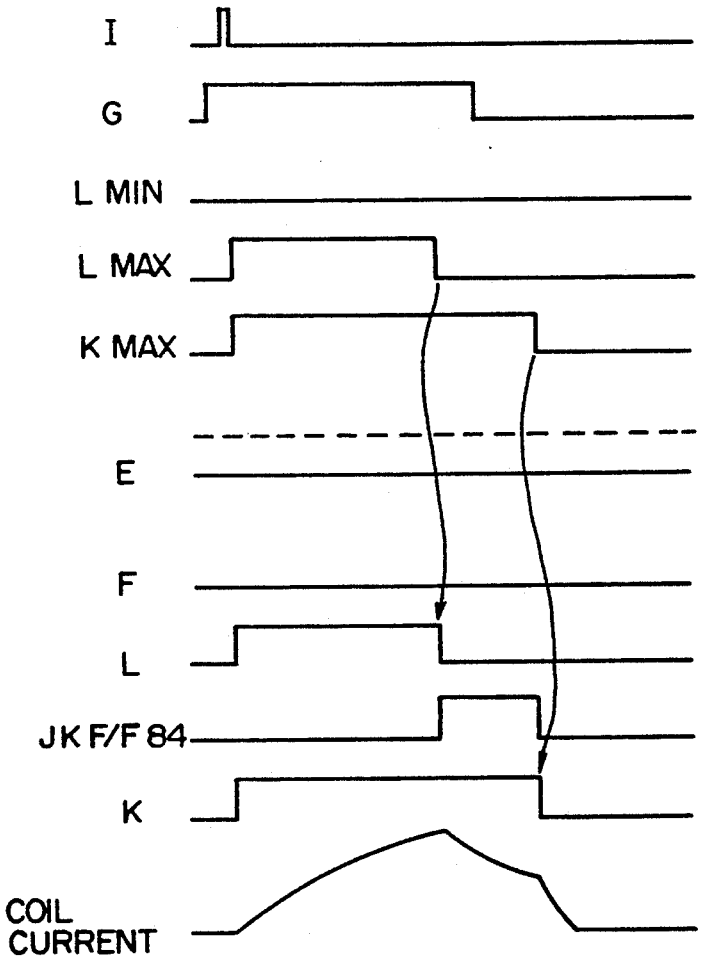
FIG. 22 is a time chart of a wire head driver in the wire dot head drive system according to the third embodiment of the present invention.

IN FIG. 21, the waveform $e_0$ of the signal E, said waveform being indicated by a solid curve, corresponds to a normal printing drive. When a high-speed printing drive is performed, the reference voltage is set lower to TH1. The waveform of a coil current at that time is indicated by $I_1$. As the waveform of a coil current required for a high-speed printing drive, however, a waveform obtained by cutting off the shaded parts of the waveform $I_1$ is ideal. This is equivalent to the waveform $e_1$ of the signal E, which is indicated by a dashed line. When such a coil current is fed, the return time of the print wire 30 becomes shorter and the recycling time is shortened. High-speed printing hence becomes feasible.

When a high-impact printing drive is performed, on the other hand, the reference voltage is set higher up to TH1. At this time, the waveform of the coil current becomes as indicated by $I_2$. As the waveform of a coil current required for a high-impact printing drive, a waveform obtained by adding the shaded part of $i_2$ is ideal. This is equivalent to the waveform $e_2$ of the signal E, which is indicated by an alternate long and short dash line. Feeding of such a coil current can accelerate the wire moving speed, thereby making it possible to conduct high-impact printing.

As has been described above, control of the reference voltage to TH0 to TH2 makes it possible to control the signal L but is difficult to control the signal K. Thus, a method for using the signals LMAX,KMAX to control the signal K too is illustrated in FIG. 22. In this case, each signal from the sensor 43 is separated from the timing pulse extractor 45 by an unillustrated switching circuit (for example, an analog switch) so that neither the signal E nor the sensor signal F is outputted. Further, the setting value of the register 68 in the limiter 64 is "0", while the registers 69,70 are set corresponding to the signals L,K to form a desired current waveform.

The present invention is not limited to the embodiments described above and can be changed or modified in various ways on the basis of the spirit of the present invention. Such changes or modifications should not be excluded from the scope of the present invention.

We claim:

1. A drive system for a wire dot head having a plurality of print wires, comprising:

armatures supporting the print wires thereon, respectively;

cores arranged opposite to the armatures, respectively;

permanent magnets for attracting the respective armatures to the associated cores;

means for forming magnetic paths through the armatures, cores and permanent magnets, respectively, so that a magnetic flux produced from the respective permanent magnets passes along the corresponding magnetic paths;

coils for producing a magnetic flux between the respective armatures and the corresponding cores to cancel the magnetic flux produced by the corresponding permanent magnets, whereby the armatures are released from the associated cores;

displacement detection means for outputting a movement starting timing signal indicating the initiation of a movement of each print wire and an impact timing signal indicating an impact of the print wire by detecting a displacement of the print wire;

combinations of first and second switching elements, each connected in series between terminals for supplying electric power from a power supply with each coil interposed between the switching elements;

first circuits for causing an electric current to continuously flow to the respective coils via the corresponding second switching elements when the associated first switching elements have changed from ON state to OFF state;

second circuits for discharging electrical energy stored in the respective coils when the corresponding second switching elements have changed from ON state to OFF state;

means for controlling a drive current for each of the coils on the basis of a print timing signal indicating the timing of a print by the corresponding print wire, the movement initiation timing signal and the impact timing signal, said control means using three timing signals for driving the coil so that:

by the first timing signal produced from the print timing signal, the first and second switching elements are both turned on to supply the electric power to the coil from the power supply, by the second timing signal produced from the movement initiation timing signal, the first switching element is turned off to cut off the supply of the electric power from the power supply and to cause the electric current to continuously flow to the coil, and by the third timing signal produced from the impact timing signal, the second switching element is turned off to discharge electrical energy stored in the coil; and means for regulating the minimum time and the maximum time from the output of the first timing signal until the output of the second timing signal and the maximum time from the output of the first timing signal until the output of the third timing signal.

2. The drive system of claim 1, wherein said regulating means comprises:

first time means for setting the minimum time from the output of the first timing signal until the output of the second timing signal, first counting means for starting counting responsive to the print timing signal, and first comparison means for comparing a count value of the first counting means with a preset value of the first time setting means, whereby the minimum time from the output of the first timing signal until the output of the second timing signal is regulated by the time set by the first time setting means;

second time setting means for setting the maximum time from the output of the first timing signal until the output of the second timing signal, second counting means for starting counting when said first counting means has counted the minimum time, and second comparison means for comparing a count value of said second counting means with the value set by said second time setting means, whereby the maximum time from the output of the first timing signal until the output of the second timing signal is regulated by the sum of the time set by said first time setting means and the time set by said second time setting means; and third time setting means for setting the maximum time from the output of the first timing signal until the output of the third timing signal, third counting means for starting counting when said first counting means has counted the minimum time, and third comparison means for comparing a count value of said third counting means with the value set by said third time setting means, whereby the maximum time from the output of the first timing signal until the output of the third timing signal is regulated by the sum of the time set by said first time setting means and the time set by said third time setting means.

3. The drive system of claim 2, wherein said displacement detection means comprises, per print wire, a sensor for detecting the capacitance between the associated armature and an electrode provided opposite to the associated armature, a differential circuit for differentiating a signal indicating a change in the capacitance between the associated armature and the corresponding electrode, and a voltage comparator means for comparing an output voltage from the differential voltage with a predetermined reference value to output a pulse of a square waveform; and said control means uses, as the movement initiation timing signal, a first edge of the pulse outputted from said voltage comparator means and, as the impact timing signal, a second edge which follows the first edge.

4. The drive system of claim 3, wherein said control means turns on the second switching element responsive to a third edge when the third edge has been outputted within a predetermined time period subsequent to the second edge and turns off the second switching element responsive to a fourth edge which follows the third edge.

5. A drive system for a wire dot head having a plurality of print wires, comprising:

a. armatures supporting the print wires thereon, respectively;

b. cores arranged opposite to the armatures, respectively;

c. coils wound around the respective cores, whereby the armatures are attracted to the associated cores upon energization of the corresponding coils but are released from the associated cores upon deenergization of the corresponding coils;

d. a plurality of displacement detecting means each for detecting a displacement of a corresponding print wire among the print wires, each displacement detection means outputting a movement initiation timing signal indicating the initiation of a movement of the corresponding print wire and an impact timing signal indicating an impact by the corresponding print wire;

e. means for controlling a drive current for each of the coils on the basis of a print timing signal, which indicates the timing of printing by the corresponding print wire, and output signals from the corresponding displacement detection means, including the movement initiation timing signal and the impact timing signal, which output signals indicate a displacement of the corresponding print wire; said controlling means using three timing signals for driving the coil associated with the print wire, including a first timing signal produced from the print timing signal to supply electric power to the coil from a power supply, second timing signal produced from the movement initiation timing signal to cut off the supply of the electric power from the power supply and to permit continuous flow of an electric current to the coil, and a third timing signal produced from the impact timing signal to discharge electrical energy stored in the coil; and f. means for regulating the control of the drive current for the coil, said control being performed based on the output signal from said corresponding displacement detection means;

said drive current control regulating means comprising (1) first time regulating means for regulating the minimum time from the output of the first timing signal until the output of the second timing signal, including:

first time setting means for setting the minimum time from the output of the first timing signal until the output of the second timing signal, first counting means for starting counting responsive to the print timing signal, and first comparison means for comparing a count value of the first counting means with a preset value of the first time setting means, whereby the minimum time from the output of the first timing signal until the output of the second timing signal is regulated by the time set by the first time setting means;

(2) second time regulating means for regulating the maximum time from the output of the first timing signal until the output of the second timing signal, including:

second time setting means for setting the maximum time from the output of the first timing signal until the output of the second timing signal, second counting means for starting counting when said first counting means has counted the minimum time, and second comparison means for comparing a count value of said second counting means with the value set by said second time setting mean, whereby the maximum time from the output of the first timing signal until the output of the second timing signal is regulated by the sum of the time set by said first time setting means and the time set by said second time setting means; and (3) third time regulating means for regulating the maximum time from the output of the first timing signal until the output of the third timing signal, including:

third time setting means for setting the maximum time from the output of the first timing signal until the output of the third timing signal, third counting means for starting counting when said first counting means has counted the minimum time, and third comparison means for comparing a count value of said third counting means with the value set by said third time setting mean, whereby the maximum time from the output of the first timing signal until the output of the third timing signal is regulated by the sum of the time set by said first time setting means and the time set by said third time setting means.

* * * * *